US005482227A

United States Patent [19]

Hystad

[11] Patent Number: 5,482,227

[45] Date of Patent: Jan. 9, 1996

[54] DEVICE FOR A CURVED CONDUCTOR PIPE FOR A PULL WIRE

[75] Inventor: Per H. Hystad, Kopervik, Norway

[73] Assignee: Karmoy Winch A/S, Kopervik, Norway

[21] Appl. No.: 319,230

[22] Filed: Oct. 6, 1994

[30] Foreign Application Priority Data

Oct. 8, 1993 [NO] Norway ..... 933605

[51] Int. Cl.[6] ..... B65H 57/12

[52] U.S. Cl. ..... 242/615.3; 254/134.3 R; 254/389

[58] Field of Search ..... 242/615.3, 397.1, 242/157 R; 254/389, 134.3 R, 134 FT, 134.3 SC; 166/341, 342; 226/196

[56] References Cited

U.S. PATENT DOCUMENTS

| | | | |
|---|---|---|---|
| 2,345,816 | 4/1944 | Hays | 242/157 R |
| 2,347,885 | 5/1944 | Crickmer | 254/389 |
| 2,659,108 | 11/1953 | Bradley | 242/157 R |
| 2,692,092 | 10/1954 | Kinsinger | 242/615.3 X |
| 3,306,581 | 2/1967 | Miller | 254/134.3 FT |
| 3,551,006 | 12/1970 | James | 285/16 |
| 4,106,156 | 8/1978 | Fisher et al. | 254/389 X |
| 4,430,023 | 2/1984 | Hayes et al. | 254/389 X |
| 4,742,993 | 5/1988 | Montgomery et al. | 242/157 R X |

FOREIGN PATENT DOCUMENTS

| | | |
|---|---|---|
| 0259539 | 3/1988 | European Pat. Off. . |
| 3836833 | 4/1990 | Germany . |
| 1598822 | 9/1981 | United Kingdom . |
| 2165328 | 4/1986 | United Kingdom . |

*Primary Examiner*—John M. Jillions
*Attorney, Agent, or Firm*—Cushman Darby & Cushman

[57] ABSTRACT

A device for a curved conductor pipe for a pull wire wherein the conductor pipe is provided along the inside thereof with a lining which has a material yield point that is higher than the compressive force that operates between the lining and the pull wire. The lining is equipped with a guide seat for the pull wire in order to distribute the compressive force from the pull wire over the lining.

3 Claims, 1 Drawing Sheet

DEVICE FOR A CURVED CONDUCTOR PIPE FOR A PULL WIRE

BACKGROUND OF THE INVENTION

The present invention relates to a device for a curved conductor pipe for a pull wire.

In a known conductor pipe of this kind, the material yield point of the conductor pipe is equal to or less than the compressive force which operates between the pull wire and the conductor pipe.

When oil production platforms are set up, large gas/oil pipes are pulled into couplers at the bottom of the platforms. To pull these pipes, a pull wire is used which is fed through a conductor pipe that is connected in a watertight manner to the gas/oil pipe coupler. The conductor pipe continues upwards into the platform shaft to a level above the surface of the water. The conductor pipe would normally always be made with a curve in the range of 80°–90° immediately after the connection to the gas/oil pipe coupler. This means that the conductor pipe is subjected to great stress, especially in instances when large gas/oil pipes are pulled into place, where the traction forces in question may be as much as 300–500 tonnes.

Normally the conductor pipe is made of a weldable steel of the St52-3 type or similar. This quality is chosen inter alia for the following reasons:

Good extension properties which provide ample protection against local peak loads and cracking.

Good welding properties which provide a secure welded connection of flanges and fixing equipment.

The pipe quality is a standard commodity and lends itself to induction bending of curves.

However, the recited steel quality has a major disadvantage for precisely the purpose as outlined above for which the steel is used in conductor pipes for pulling oil/gas pipes in connection with oil/gas installations. The pipe has a Brinell hardness in the range of 180–200. A further disadvantage is that a pull wire will not have a sufficently good seat when it is pulled through a curved conductor pipe of this kind. This is due to the contact face against the bend of the pipe being extremely small, virtually tangential, which in turn results in the compressive force between the wire and the curved conductor pipe rapidly exceeding the yield point of the conductor pipe (approx. 3,500 kg/cm$^2$).

These last-mentioned factors will in turn result in the rasping away of steel material in the conductor pipe where the wire slides, and consequently a greatly increasing friction quotient between the conductor pipe and the pull wire. In turn, this leads to reduced net hoisting power, since a great part of the winch power which is used to pull in the wire is used not least to overcome the friction between the conductor pipe and the pull wire. This results in increased wear and tear on the conductor pipe, which in turn could result in breaks in the conductor pipe and, in its most unfortunate consequence, could result in the platform leg filling up with sea water.

SUMMARY OF THE INVENTION

To overcome those disadvantages of the known art, a device of the type mentioned by way of introduction is proposed, where the conductor pipe is provided along the inside thereof with a lining which has a material yield point that is higher than the compressive force that operates between the lining and the pull wire.

The lining will preferably be tubular, the wall thickness close to the contact surface between the pull wire and the lining being greater than the wall thickness furthest away from the contact surface. Furthermore, it is of advantage to have the lining consist of two or more individually cast sections. To reduce the force per unit of area against the inside of the conductor pipe, the lining is provided with a guide seat for the pull wire.

In cross-section, the inner wall and the outer wall of the lining are approximately circular. Furthermore, the inner wall of the conductor pipe is circular in cross-section and has a radius that is greater than that of the outer wall of the lining, said conductor pipe being provided at each end with a flange which prevents the lining from sliding out of the conductor pipe.

BRIEF DESCRIPTION OF THE DRAWING

This invention will now be described in more detail with reference to the attached figures, where.

DETAILED DESCRIPTION

Figure 1:
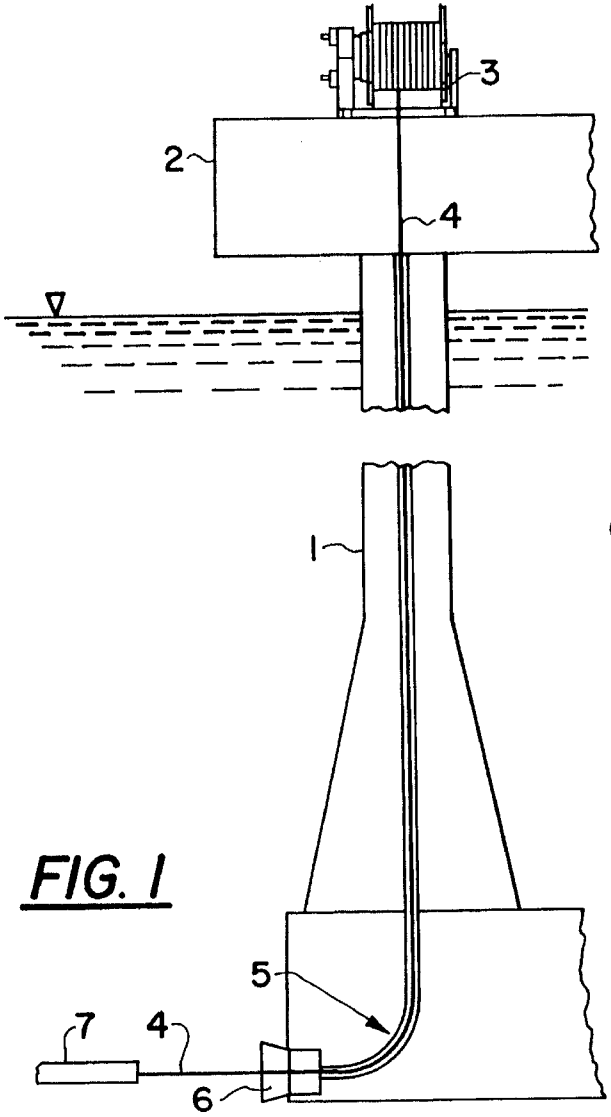
FIG. 1 shows the use of the device according to the present invention in connection with an oil production platform.

FIG. 1 illustrates a production platform consisting of a shaft 1 with a platform part 2 and a winch 3 disposed on said platform part 2. The winch 3 pulls a wire 4 which is fed through a conductor pipe device 5 and a production pipe coupler 6 that is known per se connected thereto. The production pipe 7 is pulled by means of the pull wire 4 into the coupler 6 where it is secured.

Figure 2:
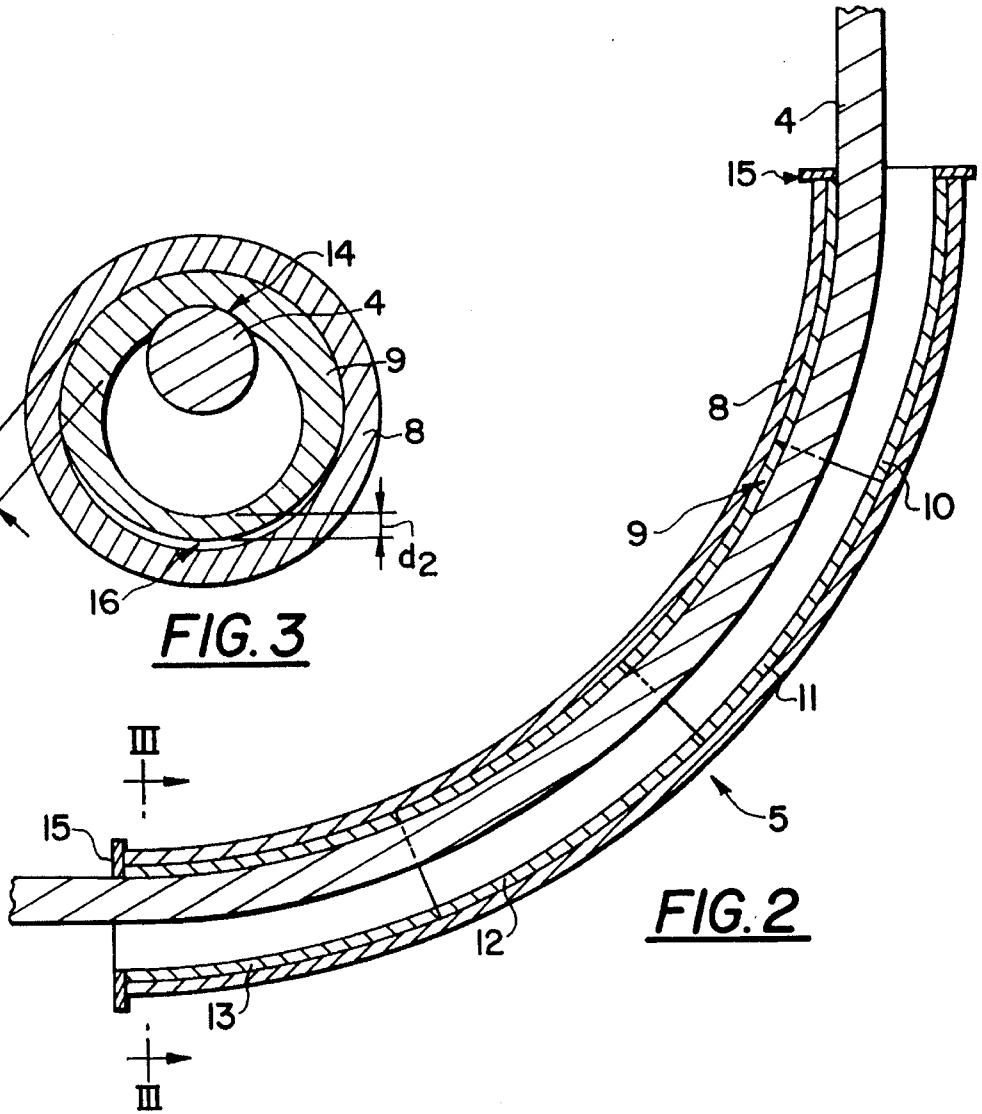
FIG. 2 illustrates the device according to the invention in connection with feeding a pull wire.

The device 5 is shown in more detail in FIG. 2. It comprises a conductor pipe 8 that is known per se. A lining is provided in the conductor pipe, this lining being generally designated by reference numeral 9 and which, in the chosen example, is made of two or more specially cast lining sections, indicated by the reference numerals 10, 11, 12 and 13 respectively. The outer wall of the sections is circular, but has a radius that is smaller than that of the inner wall of the conductor pipe 8, which is also circular in cross-section.

Figure 3:
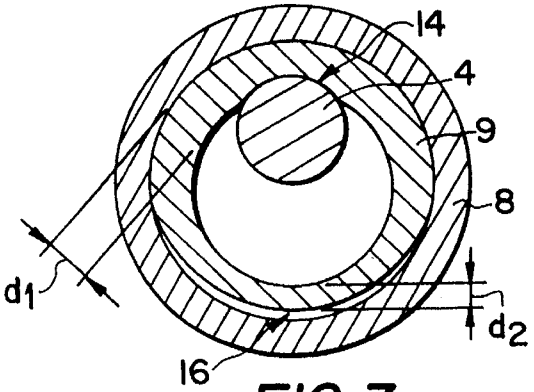
FIG. 3 shows the section III—III in FIG. 2.

The lining 9, i.e., sections 10, 11, 12 and 13, is equipped with a seat 14 which is adapted to the diameter of the pull wire 4, as can be seen in more detail in FIG. 3. This means that the compressive force that is exerted by the pull wire on the lining 9 will be distributed over a larger area than was possible when using the prior art.

According to the invention, it would be an advantage to make the sections 10, 11, 12 and 13 , i.e., the lining 9, of a material of great hardness, preferably with the range of 500–550 Brinell hardness, which provides a smooth sliding surface against the wire 4. The selection of such a hard material for the wire will prevent the wire from being pressed into the lining. Thus, the same amount of friction does not occur as was caused previously due to the rasping of the wire in the conductor pipe 8.

To ensure that the lining 9 does not slide out or become displaced relative to the conductor pipe 8, a flange 15 is attached at each end of the conductor pipe.

As can be seen from FIG. 3, the lining 9 has a thickness of $d_1$ close to the point of contact between the wire 4 and the lining 9, while the wall thickness of the lining at the point that lies furthest from said point of contact between the wire and the lining has a lesser thickness of $d_2$. Furthermore, because the outer radius of the lining 9 is smaller than the inner radius of the conductor pipe 8, there is a clearance 16 between the lining 9 and the conductor pipe 8. A number of advantages are obtained by means of the present invention in comparison with the curved conductor pipe that is in use today.

Wear and tear on the conductor pipe, which is caused by filing when the wire is in motion, is avoided by means of the invention. The conductor pipe, equipped with the lining according to the present invention, will thus maintain full strength, and ruptures in the pipe will be avoided. Increased protection against pipe ruptures will consequently provide increased safety for the operators who install oil/gas pipes.

An additional advantage provided by the present invention is that the friction between the conductor pipe and the pull wire will remain at a sufficiently reduced level to make possible the use of smaller hoisting winches and also wires of a smaller dimension.

The wear on the pull wire will also be reduced, since the wire slides against a seat that has a large area and is adapted to the wire, and said seat is provided with a smooth surface. Said sections 10, 11, 12 and 13, which form the lining 9 according to the present example, in no way limiting for the invention, will be capable of being used many times for other hoisting tasks for the pull wire 4, since wear and tear on these sections is substantially avoided by means of the present invention.

Having described my invention, I claim:

1. A lining assembly for a longitudinally archingly curved conductor pipe of a given hardness and given internal diameter, for a pull wire, which, when pulled longitudinally of the pipe while housed by the pipe would, absent said lining assembly, tend to abradingly, rubbingly engage an inner peripheral wall surface of the pipe along a longitudinal path which extends along an inner side of a longitudinally arched curve of the pipe so as to exert a compression force transversally of said pipe on said surface in said path, which, absent said lining assembly, would tend to cut into said pipe along said path, said lining assembly comprising:

a plurality of longitudinally adjoining individually cast tubular sections serially lining corresponding portions of said inner peripheral wall of said pipe;

said lining sections each having an inner peripheral surface defining respective portions of a guide seat recess which extends along said path to provide a contact face for said wire;

said lining sections being thicker within and laterally adjacent said guide seat portions, than diametrically opposite said guide seat portions; and said lining sections being made of a material which is harder than and less subject to being abradingly worn by longitudinal pulling of said wire than would be said inner peripheral surface of said pipe were said lining assembly absent.

2. The lining assembly of claim 1, wherein:

each said section of said lining assembly has a radially outer peripheral surface which is approximately circular in transverse cross-sectional figure; and said inner peripheral surface of each said section of said lining assembly, excepting said guide seat recess, is approximately circular in transverse cross section.

3. The lining assembly of claim 1, wherein:

said lining assembly includes terminal ones of said sections at opposite ends thereof, each said terminal section, at effectively opposite ends of said lining assembly having a respective radially outwardly extending flange; said flanges being greater in diameter than said given diameter and being arranged to respectively engage opposite ends of said pipe for longitudinally fixing said lining assembly relative to said pipe.

* * * * *